US007218306B2

(12) United States Patent
Balarezo

(10) Patent No.: US 7,218,306 B2
(45) Date of Patent: May 15, 2007

(54) DISPLAY DEVICE

(75) Inventor: Brando H. Balarezo, Tustin, CA (US)

(73) Assignee: Valmark Industries, Inc., Livermore, CA (US)

( * ) Notice: Subject to any disclaimer, the term of this patent is extended or adjusted under 35 U.S.C. 154(b) by 514 days.

(21) Appl. No.: 10/713,443

(22) Filed: Nov. 14, 2003

(65) Prior Publication Data

US 2004/0150658 A1 Aug. 5, 2004

Related U.S. Application Data

(60) Provisional application No. 60/430,399, filed on Dec. 3, 2002.

(51) Int. Cl.
*G09G 3/36* (2006.01)

(52) U.S. Cl. ..... 345/102; 345/32; 349/64; 362/558

(58) Field of Classification Search ..... 345/102, 345/82, 32; 349/61–64; 362/558–559, 600, 362/631

See application file for complete search history.

(56) References Cited

U.S. PATENT DOCUMENTS 6,861,789 B2 * 3/2005 Wei ..... 313/116
6,867,825 B2 * 3/2005 Kanatsu et al. ..... 349/60
7,009,771 B2 * 3/2006 Bourdelais et al. ..... 359/599
2003/0067436 A1 * 4/2003 Hara et al. ..... 345/102
2003/0098840 A1 * 5/2003 Nagatani ..... 345/102
2003/0214720 A1 * 11/2003 Bourdelais et al. ..... 359/599
2003/0214812 A1 * 11/2003 Bourdelais et al. ..... 362/330

* cited by examiner

*Primary Examiner*—Richard Hjerpe
*Assistant Examiner*—Kimnhung Nguyen
(74) *Attorney, Agent, or Firm*—Sonnenschein Nath & Rosenthal LLP; Brian R. McGinley

(57) ABSTRACT

A display device including an illumination source disposed behind an at least partially translucent display area, with a diffuser baffle disposed therebetween. The diffuser baffle includes at least one diffuser lens with a gap on at least one side thereof. Light emitted by one or more light devices on the illumination source is dispersed and scattered by the diffuser lens and gap in the diffuser baffle before being projected on the back of the at least partially translucent display area. The dispersed and scattered light from behind more evenly illuminates the at least partially translucent display area.

2 Claims, 4 Drawing Sheets

DISPLAY DEVICE

PRIOR APPLICATION

Pursuant to 37 C.F.R. § 1.78(a)(4) and 35 U.S.C. § 119(e), this application claims the benefit of U.S. Provisional Application Ser. No. 60/430,399, filed Dec. 3, 2002.

TECHNICAL FIELD

This invention relates generally to display devices and, more particularly, to a display device with a rear-illuminated display area.

BACKGROUND ART

Various types of display devices are known in the art for advertisements, signs, attractions, and the like. Display devices typically have a display area which displays graphics, pictures, characters, words, etc. of interest. Many display devices have an associated illumination means for illuminating the display area for enhancing its visibility in low lighting conditions or to make it more appealing and attention-catching to observers. Some illuminated display devices have certain portions of the display area illuminated more or differently to highlight or direct more attention to those particular portions.

The various types of illumination means known in the art for illuminating display areas of display devices vary in how they illuminate the display area. Some simply comprise a light source, such as a light bulb or a fluorescent light, directing light at the surface of the display area. Others have an at least partially translucent display area with a light source disposed behind it, whereby light from the light source passes through the at least partially translucent display area and illuminates it. Such rear-illuminated display devices, however, have drawbacks. The light source usually projects a strong bright spot, sometimes termed as a hot spot, at the location of the light source behind the display area. Further, there is a gradient of decreasing light in a direction away from the light source on the remainder of the display area. Such inconsistent illumination, particularly the hot spots at the location of the light source, project an unappealing visual impression on an observer and are therefore undesirable.

Solutions that have been proposed for this problem have shortcomings. For example, fiberoptic weaves or meshes disposed under the display area provide inconsistent illumination, and are usually unable to provide an adequate amount of illumination because of the limited amount of light they can carry and deliver. Light bulbs and fluorescent lights usually cause hot spots, and can require large amounts of electric power, usually in the form of alternating current. Therefore, they are not always practicable for use in smaller-sized or battery-powered and portable display devices. Electroluminescent lamps provide illumination proportionate to the amount of electric power provided, so although they may work in battery powered and portable devices, the illumination they provide is limited to the amount of electric power available, which may sometimes not be adequate in a battery operated or portable display device.

Accordingly, there is a need for a display device with a rear-illumination means for its display area that overcomes such problems. The present invention is directed to overcoming one or more of these problems.

SUMMARY OF THE INVENTION

In one aspect of the present invention, a display device comprises a display area that is at least partially translucent. An illumination source is disposed behind the display area, and a diffuser baffle is disposed between the illumination source and the display area. The diffuser baffle includes at least one diffuser lens and at least one spacer disposed adjacent to the diffuser lens. The spacer forms a gap between the diffuser lens and one of the display area and the illumination source.

These and other objects and advantages of the present invention will be classified in the following description of the preferred embodiment in connection with the drawings, the disclosure and the appended claims, wherein like reference numerals represent like elements throughout. The drawings constitute a part of this application and include exemplary embodiments of the present invention and illustrate various features thereof.

BRIEF DESCRIPTION OF THE DRAWINGS

Corresponding reference characters indicate corresponding parts throughout the several figures for more convenient understanding and practice of the present invention.

DETAILED DESCRIPTION

Figure 1:
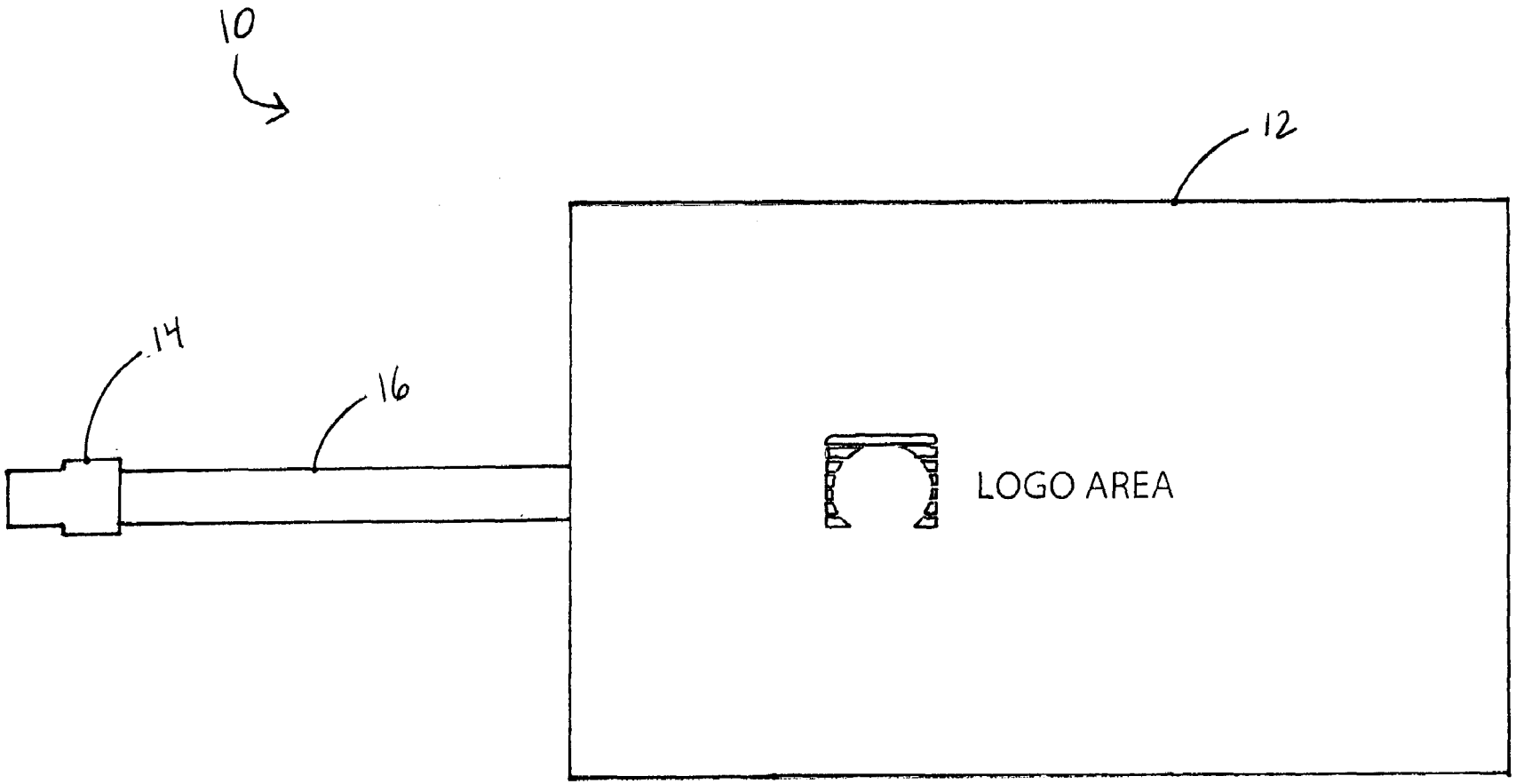
FIG. 1 is front view of a display device according to one embodiment of the present invention.

While the present invention may be embodied in many different forms, there is shown in the drawings and discussed herein a few specific embodiments with the understanding that the present disclosure is to be considered only as an exemplification of the principles of the invention and is not intended to limit the invention to the embodiments illustrated.

Referring to FIG. 1, a front view of a display device 10 according to one embodiment of the present invention is shown. Display device 10 includes a display area 12, such as a panel, which may have something of interest displayed thereon. Although display area 12 depicted in the drawings is flat and rectangular, it is recognized and anticipated that the present invention is applicable to display devices with display areas of any shape or size. Display area 12 is preferably at least partially translucent whereby at least some light may pass therethrough. Various materials are known in the art, such as partially transparent plastic or painted glass, that are at least partially translucent and are used for forming display areas in display devices.

Display device 10 is electrically coupled to an electric power source 14 by one or more electrical conductors 16. Electric power source 14 may be an external source of AC or DC electric power, or it may be an internal source of electric power such as a battery held inside or adjacent to display device 10. Electrical conductors 16 may be any component capable of conducting electric current, such as wires, leads, conductive traces on a circuit board, and the like.

Figure 2:
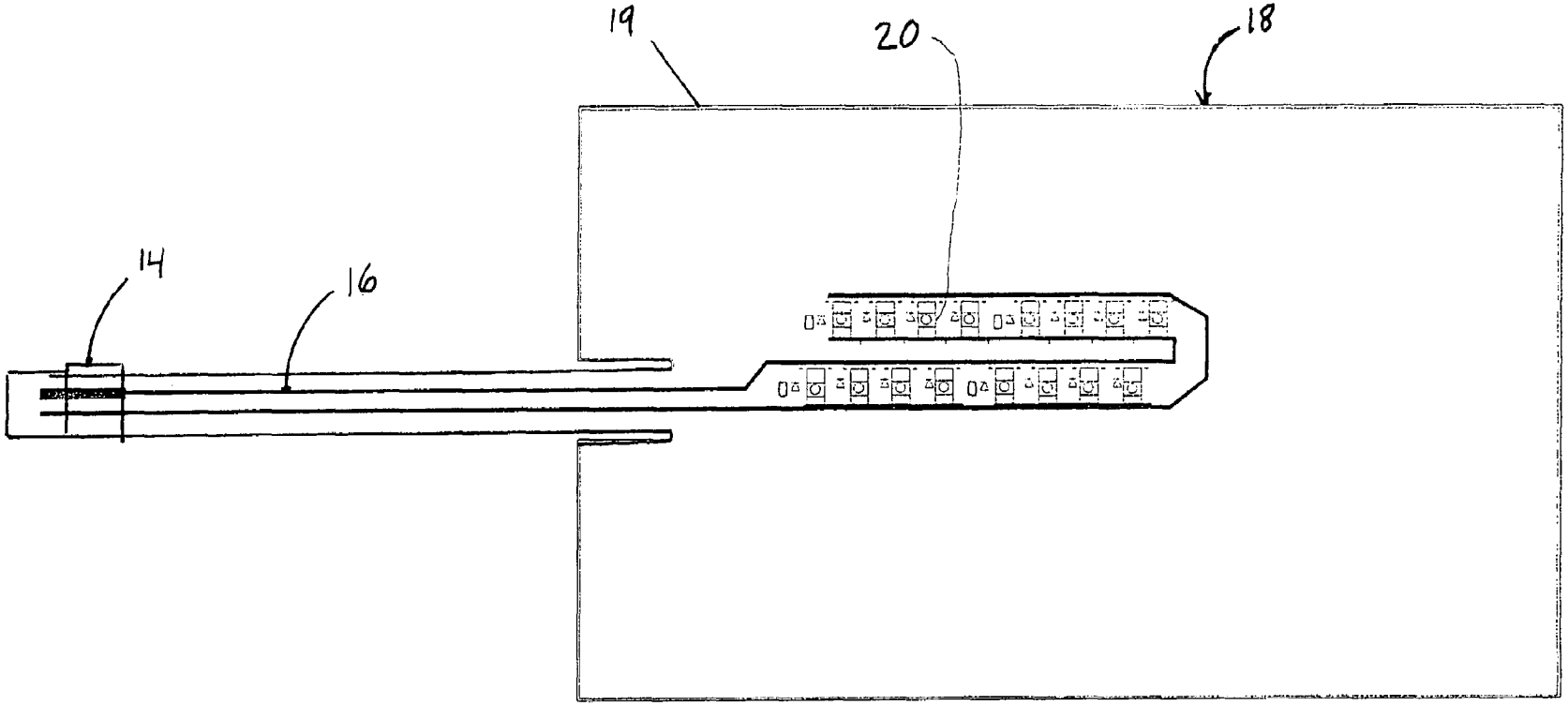
FIG. 2 is a schematic illustration of an illumination source for the display device of FIG. 1.
Figure 3:
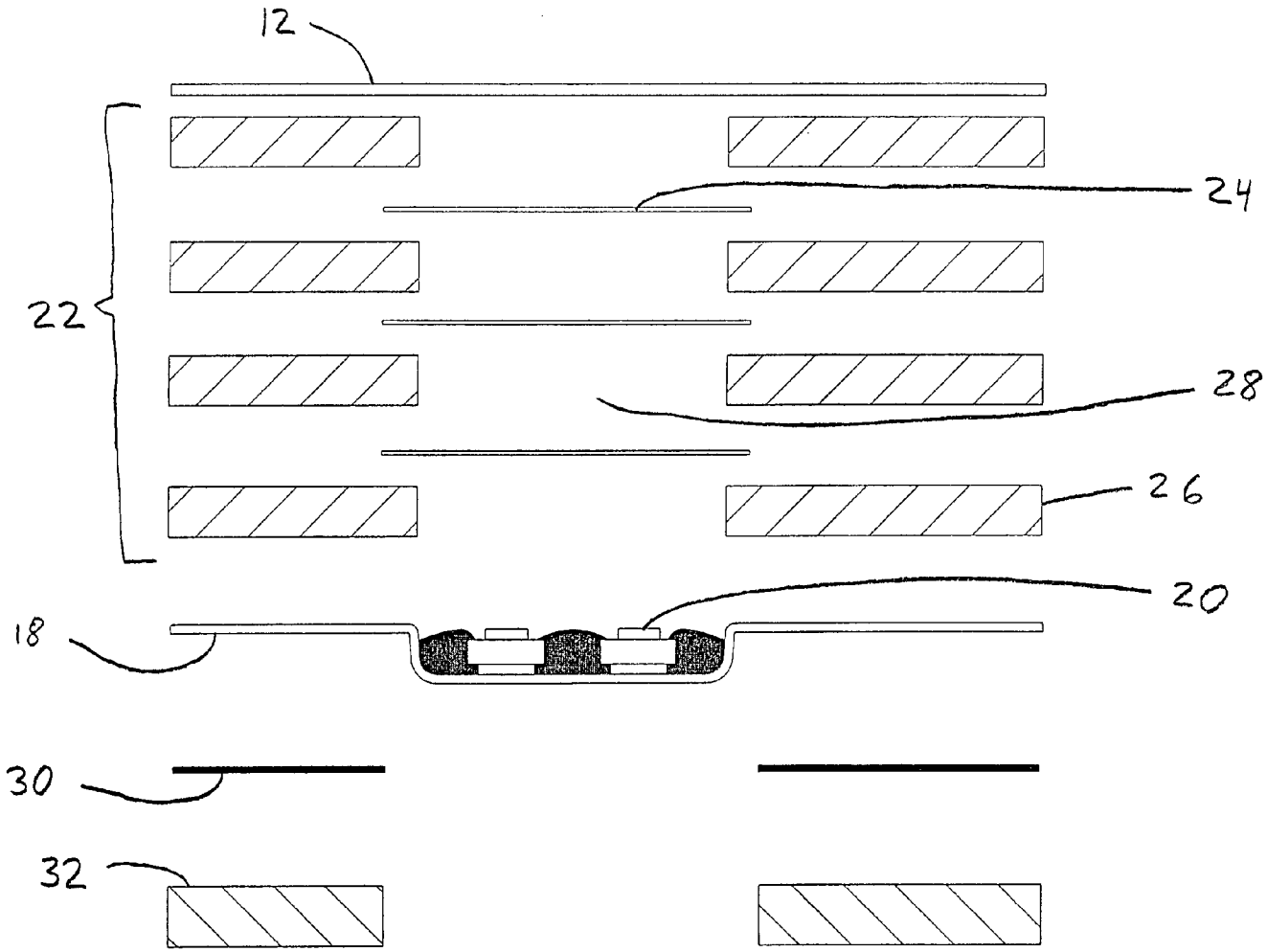
FIG. 3 is an exploded view of one embodiment of a diffuser baffle and its components implemented in the display device of claim 1.

Referring to FIG. 2, a schematic illustration of an illumination source 18 for display device 10 is shown. Illumination source 18 includes a board or panel 19 that can hold electrical or electronic components. In one embodiment, board or panel 19 is a 5 mil. thick flexible printed circuit board with electrical and electronic components embossed therein and interconnected in a predetermined manner with conductive epoxy. In such embodiment, the embossed electrical and electronic components may be potted with non-conductive UV or thermally cured resin epoxy, which is known in the art. Illumination source 18 is disposed behind display area 12 and is operable to emit light at display area 12 from behind as shown in FIG. 3 and discussed in more detail below.

Illumination source 18 includes one or more light devices 20 that are operable to emit light. In one embodiment, light devices 20 are surface-mount device (SMD) light emitting diodes (LED). In other embodiments, light devices 20 may be light bulbs, fiberoptic channels, fluorescent tubes, electroluminescent lamps, or any other means or device capable of emitting light. The number of light devices 20 in illumination source 18 will typically vary from one embodiment to another, and will usually depend on the light requirements for display area 12 in the particular embodiment of display device 10, the light output of the particular light devices 20 implemented in that embodiment, and the electrical power available from electric power source 14 in that embodiment. In this regard, it is recognized and anticipated that the types and number of light devices 20 implemented in a particular embodiment of the present invention may be customized in accordance with the particular requirements of an embodiment. In the embodiment shown in FIG. 2, illumination source 18 includes sixteen light devices 20, each of which are commercially available SMD LEDs rated 20 mA at 3.5V.

Light devices 20 may be positioned on illumination source 18 in any configuration desired for a particular embodiment of the present invention. The layout may depend on the light output of each respective light device 20 and the amount of illumination desired for the various portions of the corresponding display area 12. In the embodiment shown in FIG. 2, the sixteen light devices 20 are distributed on illumination source 18 as shown to achieve a more even distribution of illumination on display area 12.

Light devices 20 are electrically coupled to electric power source 14 via electrical conductors 16. In one embodiment, each light device 20 is connected in parallel to electric source 14 via electrical conductors 16 so that operation of a light device 20 is not impacted by the operation of other light devices 20 on that same circuit. However, it is recognized and anticipated that in alternate embodiments light devices 20 may be connected in series, or in a combination of parallel and series, without departing from the spirit and scope of the present invention.

Disposed between display area 12 and illumination source 18 is a diffuser baffle 22. Referring to FIG. 3, an exploded view of one embodiment of diffuser baffle 22 is shown implemented between display area 12 and illumination source 18. A diffuser baffle 22 according to the present invention includes at least one diffuser lens 24 with a spacer 26 on at least one side. Diffuser lenses 24 are essentially a sheet or panel of a translucent material that is preferably substantially translucent but not completely transparent, such as semi-clear plastic, vellum, polyester, paper, elastomer, or the like. The thickness of each diffuser lens 24 may vary, and is 5 mils in one embodiment. Spacers 26 serve the purpose of separating the items disposed on each side thereof and to form a gap 28 between those items. In this regard, spacers 26 may be made of any material such as polycarbonate, polyester, plastic, wood, and the like. In one embodiment, spacers 26 include a pressure-sensitive adhesive for implementation in diffuser baffle 22 by adhering the pressure-sensitive adhesive with an adjoining item. The thickness of spacers 26 may be adjusted in each embodiment to correspond to the thickness of gap 28 desired between the items on each side of the respective spacer 26 in that particular embodiment. In one embodiment, the thickness of spacers 26 is 9 mils. each.

In the embodiment shown in FIG. 3, diffuser baffle 22 includes three diffuser lenses 24 separated by spacers 26 with gaps 28 formed by spacers 28. In one embodiment, gaps 28 consist of ambient air disposed between the items on each side of the respective spacer 26. In alternate embodiments, gaps 28 may consist of an inert gas, such as Nitrogen, held in the gap by an airtight laminating material that laminates the spacer and at least one of its adjoining items. Many types of airtight transparent laminating materials are known in the art.

In this configuration, display area 12 on display device 10 is illuminated from behind when electric power source 14 provides electric power to light devices 20. Light emitted by light devices 20 passes through each of the gaps 28 and diffuser lenses 24 between illumination source 18 and display area 12. During such travel, the light is dispersed by each diffuser lens 24. The dispersed light from a diffuser lens 24 is scattered over a wider area because of the gap 28 following that diffuser lens 24. This dispersed and scattered light is further dispersed and scattered by each successive diffuser lens 24 and gap 28. As a result, when the light reaches display area 12, it is considerably dispersed and scattered from its origin which was at one or more specific source points. This dispersed and scattered light travels through the at least partially translucent display area 12 and gives the aesthetic impression of an illuminated display area 12 with comparatively more even illumination and considerably reduced or no hot spots.

In this regard, those skilled in the art will appreciate that increasing the number of diffuser lenses 24 and gaps 28 in an embodiment of the present invention will directly correlate to more even scattering and dispersion of light emitted by light devices 20 on display area 12 and, therefore, minimizing the appearance of hot spots.

In the embodiment shown in FIG. 3, display device 10 also includes a holding means 30 and 32 for holding illumination source 18 more securely in display device 10. Holding means 30 and 32 may be constructed of any material known in the art, and it is recognized that they are optional and not critical for practicing the present invention.

Figure 4:
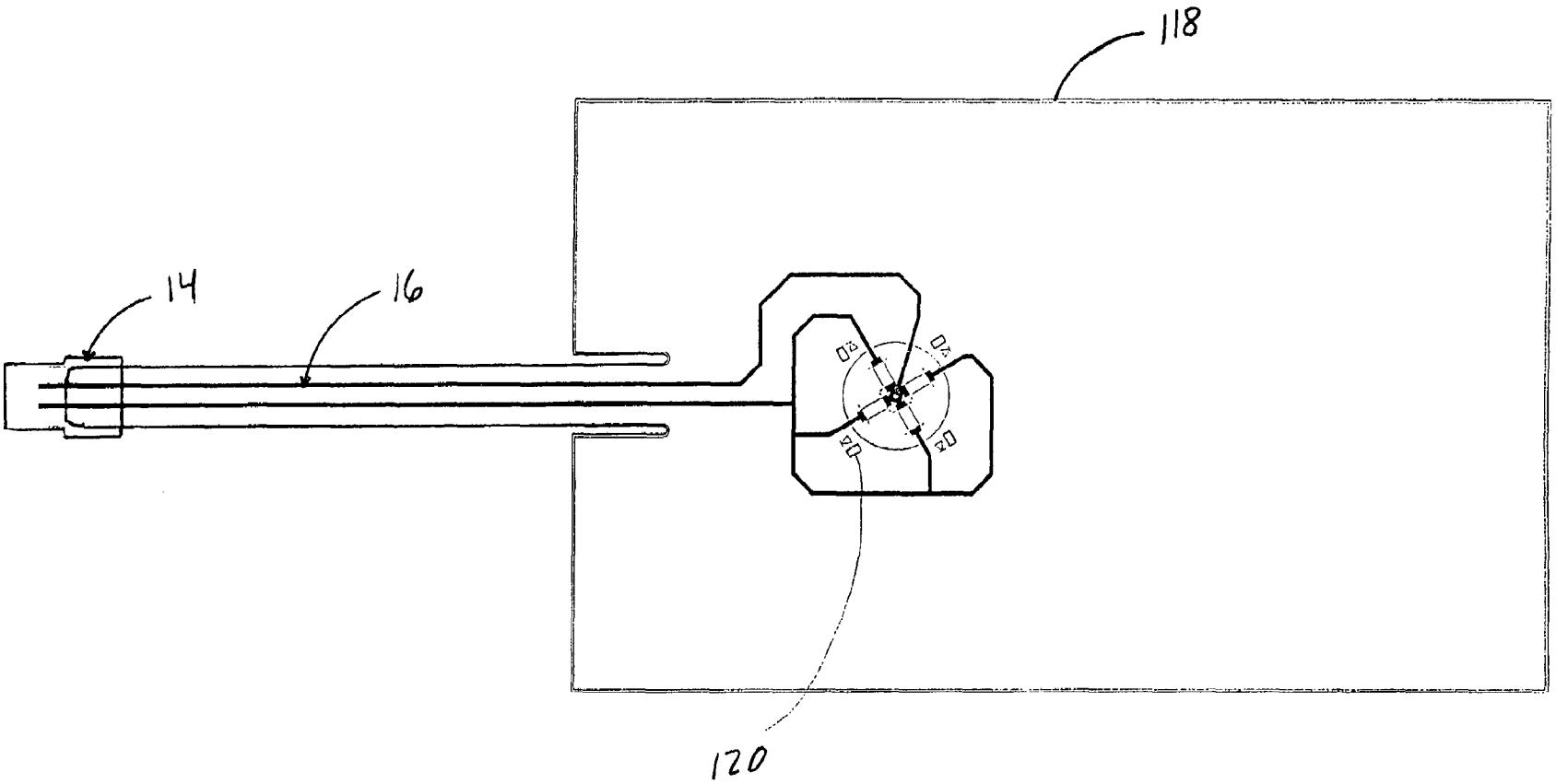
FIG. 4 is a schematic illustration of an alternate embodiment of an illumination source for the display device of FIG. 1.

In alternate embodiments of the present invention, diffuser lenses 24 and the placement of light devices 20 may be altered to control the illumination of display area 12. For example, if a certain portion of display area 12 needs to be highlighted more than other areas, such as to highlight a logo or trademark, a light device 20 may be placed directly behind such area and the portions of the diffuser lenses 24 directly between that light device 20 and the portion to be highlighted may be made thinner, or more transparent, or removed altogether, to increase the amount of light delivered to that portion of the display area 12. Referring to FIG. 4, a schematic illustration of an alternate embodiment of an illumination source 118 for a display device 10 is shown wherein four light devices 120 are strategically placed in a certain concentrated circular pattern to deliver comparatively more light to the middle portion of the left half of the corresponding display area 12. In alternate embodiments, the strength and types of light devices 20 and their respective placement or pattern on illumination source 18 behind display area 12 may be customized to suit the particular requirements of the respective embodiment. Such patterns may include, for example, light devices 18 implemented in a square pattern, a triangular pattern, an uneven zigzag pattern, or the like. Accordingly, all such modifications and alterations are recognized and anticipated, and it is intended that the claims shall cover all such embodiments that do not depart from the spirit and scope of the present invention.

It is further recognized and anticipated that electronic controls and other features may be implemented in the electric circuitry associated with illumination source 18 of display device 10. For example, a switch (not shown in the drawings) may be added to the electric circuit formed by electric power source 14, electrical conductors 16, and light devices 20 to selectively switch light devices 20, and consequently the illumination on display area 12, on and off. The switch may be any type of electric switch, and is a membrane switch in one embodiment. Membrane switches are known in the art.

In one embodiment, electronic control means may be added to the circuit formed by electric power source 14, electrical conductors 16, and light devices 20 to control the operation of light devices 20 in a predetermined manner. For example, various light devices 20 may be programmed to turn on and off or blink in a predetermined manner or pattern to enhance the aesthetic appeal of the contents displayed on display area 12 or to make them more attention-catching for observers. Or, light devices 20 of different colors may be implemented in certain patterns and their operation may be controlled to enhance the message or appeal of the contents of display area 12. Various electronic control means to perform such operations with light devices, particularly with LEDs, are well known in the art and many are commonly available commercially.

As is evident from the foregoing description, certain aspects of the present invention are not limited by the particular details of the embodiments illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from studying the drawings, the disclosure, and the appended claims.

What is claimed is:

1. A display device, comprising:

a display area, said display area being at least partially translucent;

an illumination source disposed behind said display area; and a diffuser baffle disposed between said illumination source and said display area, said diffuser baffle comprising:

at least one spacer;

at least one diffuser lens disposed adjacent to said at least one spacer, wherein said at least one spacer forms a gap between said at least one diffuser lens and one of said display area and said illumination source;

a second spacer disposed on a side of said at least one diffuser lens opposite from said at least one spacer; and a second diffuser lens disposed adjacent to said second spacer, wherein said second spacer forms a gap between said second diffuser lens and one of said display area and said illumination source.

2. The display device of claim 1, wherein said diffuser baffle further comprises:

a third spacer disposed on a side of said second diffuser lens opposite from said second spacer; and a third diffuser lens disposed adjacent to said third spacer, wherein said third spacer forms a gap between said third diffuser lens and one of said display area and said illumination source.

* * * * *